US010356525B2

(12) United States Patent
Rocca

(10) Patent No.: US 10,356,525 B2
(45) Date of Patent: Jul. 16, 2019

(54) METHOD FOR CALIBRATING A MICROPHONE AND MICROPHONE

(71) Applicant: TDK Corporation, Tokyo (JP)

(72) Inventor: Gino Rocca, Copenhagen (DK)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 16/085,052

(22) PCT Filed: Mar. 13, 2017

(86) PCT No.: PCT/EP2017/055834
§ 371 (c)(1),
(2) Date: Sep. 14, 2018

(87) PCT Pub. No.: WO2017/157847
PCT Pub. Date: Sep. 21, 2017

(65) Prior Publication Data

US 2019/0090058 A1 Mar. 21, 2019

(30) Foreign Application Priority Data

Mar. 15, 2016 (DE) ..... 10 2016 104 742

(51) Int. Cl.
*H04R 3/06* (2006.01)
*H04R 19/00* (2006.01)
(Continued)

(52) U.S. Cl.
CPC ..... *H04R 3/06* (2013.01); *H04R 19/005* (2013.01); *H04R 19/04* (2013.01); *H04R 29/004* (2013.01); *H04R 2201/003* (2013.01)

(58) Field of Classification Search
USPC ..... 381/58, 113
See application file for complete search history.

(56) References Cited

U.S. PATENT DOCUMENTS 6,249,237 B1 6/2001 Prater
8,625,812 B2 1/2014 Goldstein
(Continued)

FOREIGN PATENT DOCUMENTS

CN 202524557 U 11/2012
CN 203984683 U 12/2014

OTHER PUBLICATIONS

International Search Report in International Patent Application No. PCT/EP2017/055834, dated Jun. 16, 2017 (4 pages).
(Continued)

*Primary Examiner* — David L Ton
(74) *Attorney, Agent, or Firm* — Nixon Peabody LLP

(57) ABSTRACT

A method for calibrating a microphone that includes a transducer element and an ASIC. The method includes calibrating the frequency characteristic of the ASIC such that the sensitivity ($S_{mic}(f_{LLF})$) of the microphone at a predetermined cutoff frequency ($f_{LLF}$) shows a predefined reduction ($\Delta$) compared to the sensitivity ($S_{mic}(f_{standard})$) of the microphone at a standard frequency ($f_{standard}$). Another aspect of the present invention concerns a microphone.

18 Claims, 3 Drawing Sheets

(51) Int. Cl.
*H04R 29/00* (2006.01)
*H04R 19/04* (2006.01)

(56) References Cited

U.S. PATENT DOCUMENTS

| | | | | |
|---|---|---|---|---|
| 9,236,041 | B2 | 1/2016 | Asada | |
| 9,282,406 | B2 | 3/2016 | Bogason | |
| 2008/0075306 | A1 | 3/2008 | Poulsen | |
| 2008/0170515 | A1 | 7/2008 | Masuda | |
| 2013/0034143 | A1 | 2/2013 | Acosta-Serafini | |
| 2013/0044898 | A1* | 2/2013 | Schultz | H04R 3/06 381/111 |
| 2014/0086433 | A1 | 3/2014 | Josefsson | |
| 2014/0328497 | A1 | 11/2014 | Burnett | |
| 2015/0030166 | A1* | 1/2015 | Ranieri | H04R 29/005 381/58 |
| 2016/0133271 | A1* | 5/2016 | Kuntzman | H03F 3/183 381/94.2 |
| 2016/0381456 | A1* | 12/2016 | Doller | H04R 29/004 381/113 |

OTHER PUBLICATIONS

Written Opinion in International Patent Application No. PCT/EP2017/055834, dated Jun. 16, 2017 (6 pages).

* cited by examiner

METHOD FOR CALIBRATING A MICROPHONE AND MICROPHONE

CROSS-REFERENCE TO RELATED APPLICATIONS

This application is a U.S. National Stage of International Application No. PCT/EP2017/055834, filed Mar. 13, 2017, which claims the benefit of Germany Patent Application No. 102016104742.2, filed Mar. 15, 2016, both of which are incorporated herein by reference in their entireties.

The present invention concerns a method for calibrating a microphone and a microphone.

In particular, the present invention concerns a method which allows to calibrate the sensitivity of a microphone such that a predetermined cut-off frequency can be realized. The cutoff frequency is also referred to as a low limiting frequency (LLF). For frequencies below a cutoff frequency the sensitivity of the microphone drops significantly. In particular, the frequency at which the sensitivity of the microphone drops by 3 dB or another predefined reduction compared to the sensitivity at a standard frequency can be defined as the cutoff frequency of the microphone.

The sensitivity of the microphone can be defined as the ratio of an analog output voltage or a digital output value provided by the microphone in response to a given input pressure. The sensitivity and the cutoff frequency are key specifications of any microphone.

Due to almost unavoidable process variations in the manufacturing of a MEMS transducer element, it is very challenging to control the cutoff frequency of a microphone. In particular, the cutoff frequency of a transducer element is mostly determined by a diameter of a ventilation hole. In principle, it is possible to reduce the variations in the cutoff frequency of a transducer element by using ventilation holes with larger diameters. However, as a tradeoff, a ventilation hole having a larger diameter results in a reduced Signal-to-Noise ratio.

It is an object of the present invention to provide a method which allows to improve the calibration of a microphone. Moreover, it is another object of the present invention to provide an improved microphone.

These objects are solved by a method according to pending claim 1 and by a microphone according to the second independent claim.

A method for calibrating a microphone comprising a transducer element and an ASIC is provided. The method comprises the step of calibrating the frequency characteristic of the ASIC such that the sensitivity of the microphone at a predetermined cutoff frequency shows a predefined reduction compared to the sensitivity of the microphone at a standard frequency.

It is the basic idea of the present invention that the almost unavoidable process variations which result in variations of the cutoff frequency of the transducer element can be compensated for by calibrating the frequency characteristic of the ASIC. This method allows to calibrate the microphone such that it has a well-defined predetermined cutoff frequency. Overall, the cutoff frequency of the microphone may be determined by a cascade of the frequency response of the transducer element and the frequency response of the ASIC. Hereby, both of the transducer element and the ASIC may act as a high pass filter.

The predefined reduction may be a reduction of 3 dB plus/minus tolerances of 0.2 dB. The standard frequency may be a frequency in the middle of a response band of the microphone, e.g. 1 kHz.

The transducer element may be a MEMS device.

The term "frequency characteristic of the ASIC" may refer to the frequency response or the sensitivity of the ASIC. The frequency characteristic may describe the frequency dependency of an output voltage provided by the ASIC in response to a given input signal. For frequencies below the cutoff frequency, the frequency characteristic shows a significant drop in the sensitivity.

In the same manner, a frequency characteristic of the transducer element and a frequency characteristic of the microphone can be defined. The frequency characteristic of the microphone is determined by the frequency characteristic of the transducer element and by the frequency characteristic of the ASIC. Thus, by calibrating the frequency characteristic of the ASIC, variations in the frequency characteristic of the transducer element can be compensated for. Thereby, the method enables to produce microphones with an identical frequency characteristic even if each if the microphones comprises a transducer element with a different frequency characteristic as the calibration of the ASIC allows to compensate these differences.

The frequency characteristic of the ASIC may be calibrated by a successive approximation algorithm which adjusts the frequency characteristic of the ASIC stepwise until the difference between the sensitivity of the microphone at the standard frequency and the sensitivity of the microphone at the predetermined cut-off frequency is equal to the predefined reduction. In particular, said difference may be equal to the predefined reduction within an acceptable tolerance limit of 0.2 dB.

The use of a successive approximation algorithm has proven to be a very effective method for fine-tuning the ASIC. In particular, it allows to calibrate and fine-tune the ASIC until the cut-off frequency has been converged to the desired target value.

In the successive approximation algorithm, the difference between the sensitivity of the microphone at the standard frequency and the sensitivity of the microphone at the predetermined cutoff frequency is calculated, wherein the frequency characteristics of the ASIC is adjusted based on the calculated difference and information stored in a look-up table. The use of a look-up table may help to significantly accelerate the calibration process. In particular, in most cases one calibration step may be sufficient to adjust the frequency characteristic of the ASIC as values stored in the look-up table may give precise information on the required adjustments.

The ASIC may comprise an adjustable high pass filter, wherein the frequency characteristics of the ASIC are calibrated by adjusting the cutoff frequency of the adjustable high pass filter. The high pass filter may be a passive filter or an active filter comprising transistors. The adjustable high pass filter may comprise one or more adjustable components which allow to amend the cutoff frequency of the high pass filter.

The cutoff frequency of the adjustable high pass filter may be reduced, if the calculated difference is below the predefined reduction. The cutoff frequency of the adjustable high pass filter may be increased, if the calculated difference is above the predefined reduction. The corresponding reduction or increase of the cutoff frequency of the adjustable high pass filter may be repeated in each step of a stepwise approximation algorithm until the cutoff frequency of the microphone is set to the predefined value. A reduction of the cutoff frequency of the high pass filter may result in a reduction of the cutoff frequency of the ASIC. An increase of the cutoff frequency of the high pass filter may result in an increase of the cutoff frequency of the ASIC.

In a last step of the method, a setting of the frequency characteristic of the ASIC may be stored in a non-volatile memory. The non-volatile memory may be a one-time programmable device. Accordingly, the calibration method may be carried out only a single time in a final step of the manufacturing process such that a customer using the microphone may not amend the setting of the frequency characteristic of the ASIC.

According to a further aspect of the present invention, a microphone is provided which comprises a transducer element and an ASIC, wherein the ASIC comprises an adjustable high pass filter, wherein the microphone further comprises a non-volatile memory which stores information for a setting of the adjustable high pass filter, wherein the stored information allows to set the adjustable high pass filter such that the sensitivity of the microphone at a predetermined cutoff frequency shows a predefined reduction compared to the sensitivity of the microphone at a standard frequency.

Accordingly, the microphone has a well-defined frequency characteristic. Having a predetermined cutoff frequency is important for applications wherein low frequency noise, e.g. due to wind, may distort a signal. Wind noises typically have a low frequency which is cut off or at least significantly attenuated if a predetermined cutoff frequency of the microphone is chosen. Moreover, being able to define the cutoff frequency of a microphone with high precision is also important for applications with more than one microphone. For such applications, it is typically necessary that each of the microphones has the same frequency characteristic.

The transducer element may define a cutoff frequency. The ASIC may have a cutoff frequency. Each of the cutoff frequencies of the ASIC and of the transducer element may be lower than the predetermined cutoff frequency of the microphone.

The high pass filter may be configured to allow tuning its cutoff frequency to a value between 10 Hz and 50 Hz. The transducer element may define a cutoff frequency in the range of 40 Hz to 80 Hz.

The ASIC may comprise a preamplifier. The adjustable high pass filter may be integrated into the preamplifier. Such a design of the ASIC places the adjustable high pass filter close to the beginning of the signal chain inside the ASIC. This may be advantageous with respect to the area consumed by the ASIC. In particular, such a design may help to save size and costs.

The ASIC may comprise s preamplifier and a second amplifier wherein the adjustable high pass filter is arranged between the preamplifier and the second amplifier. Such a design may place the adjustable high pass filter further towards the end of the signal chain of the microphone. This design is advantageous in view of the signal-to-noise ratio. In particular, the adjustable high pass filter may introduce noise and arranging it after the preamplifier may ensure that the noise is not amplified by the preamplifier.

The ASIC may comprise a preamplifier and a sigma-delta converter, wherein the adjustable high pass filter is arranged between the preamplifier and the sigma-delta converter. Again, this design is advantageous in view of the signal-to-noise ratio.

In the following, the present invention is described in further detail with respect to the figures.

Figure 1:
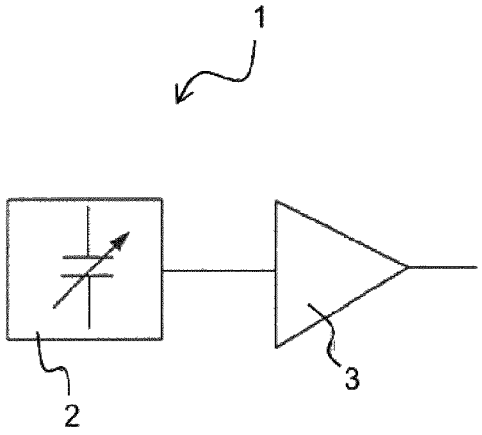
FIG. 1 shows a schematic view of a microphone.

FIG. 1 shows a schematic representation of a microphone 1. The microphone 1 comprises a MEMS transducer element 2 and an ASIC 3 (ASIC=application specific integrated circuit). The transducer element 2 is configured to convert an acoustic signal into an electric signal. The electric signal is fed into the ASIC 3. The ASIC 3 is configured to process the electrical signal. For example, the ASIC 3 comprises a preamplifier, a second amplifier and an analog-to-digital-converter, e.g. a sigma-delta converter. The preamplifier and the second amplifier are configured to amplify a respective input signal. The analog-to-digital-converter is configured to convert an analog input signal into a digital output signal.

Figure 2:
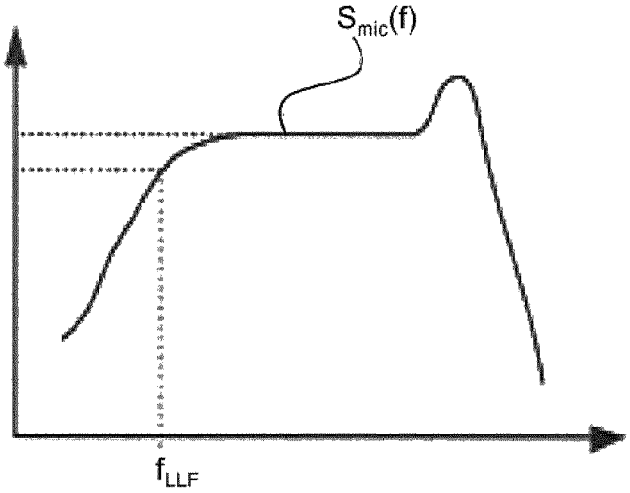
FIG. 2 shows the frequency characteristic of a microphone.

FIG. 2 shows the frequency characteristics of the microphone shown in FIG. 1. In particular, the frequency of an acoustic input signal is represented on the axis of abscissae. The sensitivity of the microphone 1 at the respective frequency is represented on the axis of ordinates. The sensitivity expresses the microphone's ability to convert the acoustic input signal into an electrical voltage. The axis of ordinates is given in a logarithmic scale. The graph $S_{mic}(f)$ shown in FIG. 2 is also referred to as frequency response of the microphone.

The sensitivity $S_{mic}(f)$ of the microphone 1 corresponds to the product of the sensitivity $S_{MEMS}(f)$ of the transducer element 2 multiplied with the sensitivity $S_{ASIC}(f)$ of the ASIC 3:

$$S_{mic}(f)=S_{MEMS}(f)\times S_{ASIC}(f)$$

As can be seen in FIG. 2, the sensitivity $S_{mic}(f)$ of the 1 microphone is frequency-dependent. For frequencies below a cutoff frequency $f_{LLF}$ which is also referred to as a low limiting frequency (LLF), the sensitivity $S_{mic}(f)$ of the microphone 1 drops significantly. The cutoff frequency $f_{LLF}$ has been marked in FIG. 2. The cutoff frequency $f_{LLF}$ is defined as the frequency for which the following equation holds:

$$S_{mic}(f_{standard})-S_{mic}(f_{LLF})=\Delta$$

$S_{mic}(f_{standard})$ gives the sensitivity of the microphone at a standard frequency. The standard frequency $f_{standard}$ can be 1 KHz, for example. In general, the standard frequency $f_{standard}$ shall be a frequency which lies in the middle of a response band of the microphone 1. The standard frequency $f_{standard}$ shall be a frequency at which the microphone 1 has a high sensitivity. Δ gives a predefined reduction in the sensitivity of the microphone. The predefined reduction Δ can be 3 dB±an acceptable tolerances. The acceptable tolerances may be 0.2 dB.

Figure 3:
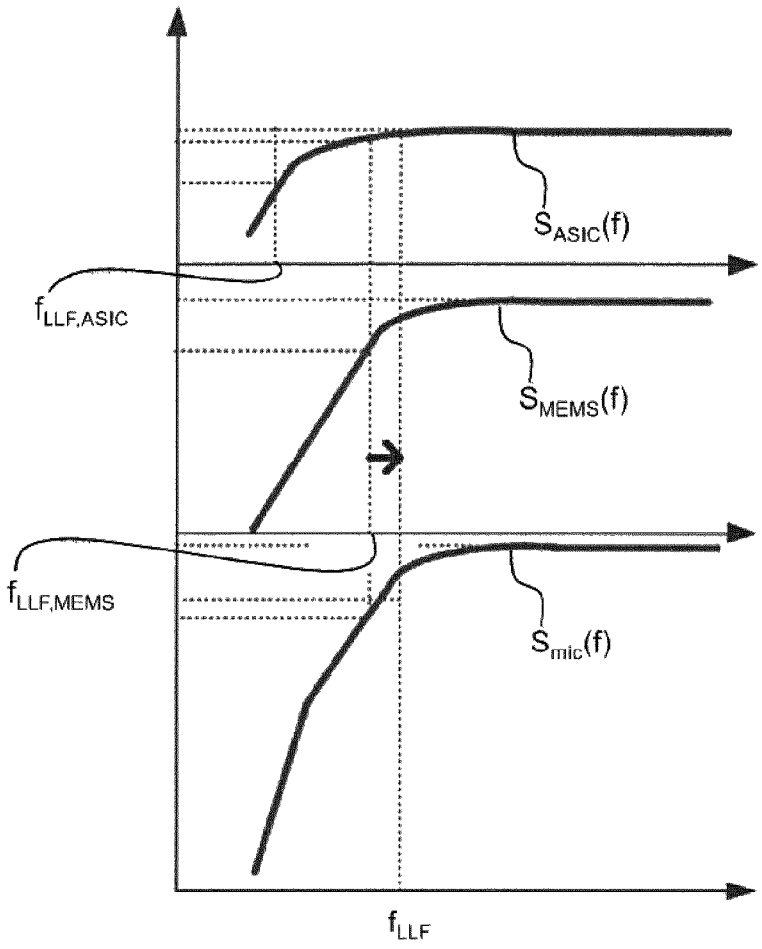
FIG. 3 shows the frequency characteristics of a microphone, a transducer element and an ASIC for small frequencies.

FIG. 3 shows the respective frequency characteristics of the microphone 1, the transducer element 2 and the ASIC 3 for low frequencies. Again, the frequency of the respective input signal is shown on the axis of abscissae. The sensitivity of the respective element at the corresponding frequency is shown on the axis of ordinates which has a logarithmic scale.

In FIG. 3, the graph $S_{mic}(f)$ represents the sensitivity of the microphone. The graph $S_{MEMS}(f)$ represents the sensitivity of the transducer element 2. The graph $S_{ASIC}(f)$ represents the sensitivity of the ASIC 3. As discussed above, the sensitivity $S_{mic}(f)$ of the microphone 1 can be calculated as the product of the sensitivity $S_{MEMS}(f)$ of the transducer element 2 multiplied by the sensitivity $S_{ASIC}(f)$ of the ASIC 3. For the transducer element 2, a cutoff frequency $f_{LLF,MEMS}$ can be defined as the frequency at which the sensitivity $S_{MEMS}(f_{LLF,MEMS})$ is reduced by a predefined reduction Δ compared to the sensitivity $S_{MEMS}(f_{standard})$ at a standard frequency which may be 1 kHz. The predefined reduction Δ may be 3 dB±0.2 dB:

$$S_{MEMS}(f_{standard})-S_{MEMS}(f_{LLF,MEMS})=\Delta$$

For the ASIC 3, a cutoff frequency $f_{LLF,ASIC}$ can be defined in the same manner:

$$S_{ASIC}(f_{standard})-S_{ASCI}(f_{LLF,ASIC})=\Delta$$

The cutoff frequency $f_{LLF}$ of the microphone 1, the cutoff frequency $f_{LLF,MEMS}$ of the transducer element 2 and the cutoff frequency $f_{LLF,ASIC}$ of the ASIC 3 have been marked in FIG. 3. As shown in FIG. 3, the cutoff frequency $f_{LLF}$ of the microphone 1 is higher than the cutoff frequency $f_{LLF,MEMS}$ of the transducer element 2 and the cutoff frequency $f_{LLF,ASIC}$ of the ASIC 3.

The cutoff frequency $f_{LLF,MEMS}$ of the transducer element 2 is mostly defined by the diameter of a ventilation hole of the transducer element 2. Because of almost unavoidable tolerances due to variations in the fabrication process of the transducer element 2, variations in the range of plus/minus 30% of the cutoff frequency $f_{LLF,MEMS}$ of the transducer element 2 are not uncommon. The cutoff frequency $f_{LLF,MEMS}$ of the transducer element 2 has been designed to be between 40 and 80 Hz. After a manufacture of the transducer element 2 has been completed, it is rather difficult to amend its cutoff frequency $f_{LLF,MEMS}$.

The ASIC 3 is designed to allow variations in its cutoff frequency $f_{LLF,ASIC}$. The ASIC 3 may comprise an adjustable high pass filter wherein it is possible to adjust the high pass filter such that a cutoff frequency $f_{LLF,ASIC}$ of the ASIC 3 can be amended. For example, the cutoff frequency of the ASIC 3 can be tuned in the range of 10 to 50 Hz in a defined number of steps, for example in eight steps.

It is the basic idea of the present invention to tune the cutoff frequency $f_{LLF,ASIC}$ of the ASIC 3 such that the unavoidable tolerances of the cutoff frequency $f_{LLF,MEMS}$ of the transducer element 2 can be compensated. Thereby, the frequency characteristic of the microphone 1 can be calibrated such that a well-defined cutoff frequency $f_{LLF}$ of the microphone 1 can be realized.

Figure 4:
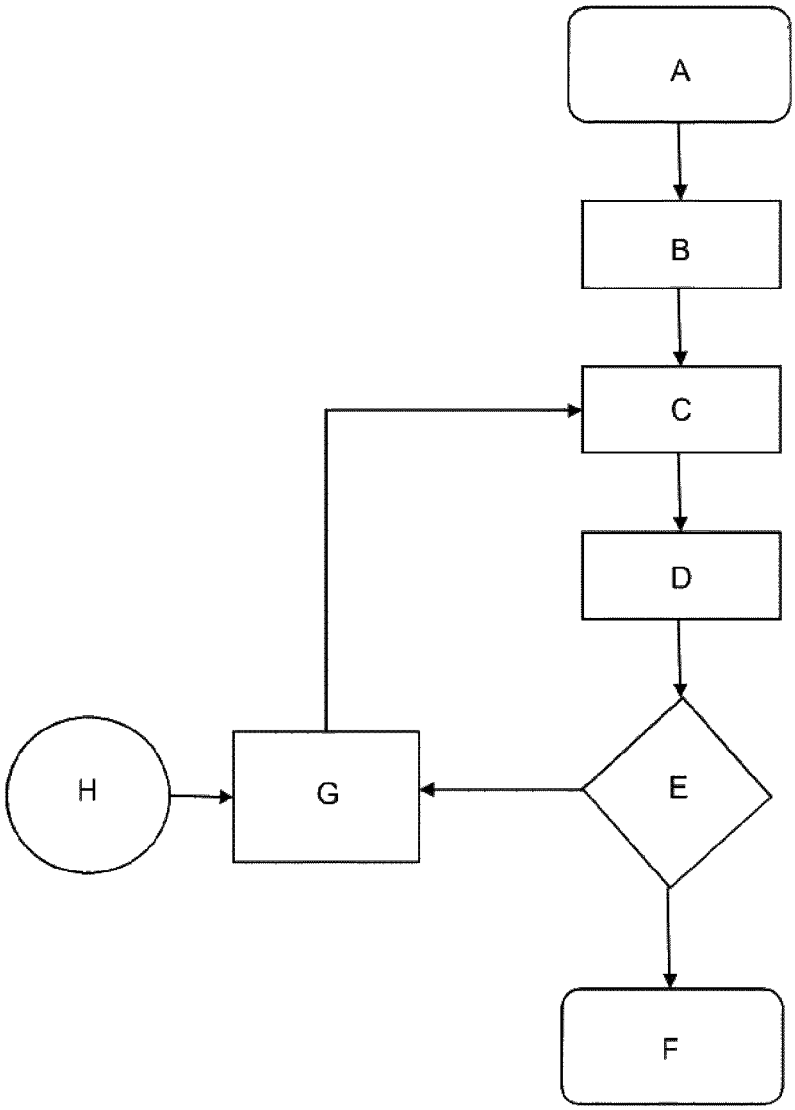
FIG. 4 shows a flowchart of a method for calibrating the microphone.

FIG. 4 shows a flowchart representing a method for calibrating a microphone 1 which allows to calibrate the frequency characteristics of the microphone 1 such that the cutoff frequency $f_{LLF}$ is set to a predetermined value. A represents an initial state at the beginning of the method wherein no adjustments of the frequency characteristic of the ASIC 3 have been carried out. In a first step B of the method, the sensitivity $S_{mic}(f_{standard})$ of the microphone 1 at a standard frequency $f_{standard}$ is measured. The standard frequency $f_{standard}$ may be 1 KHz.

After step B, step C is carried out wherein the sensitivity of the microphone 1 at the predetermined cutoff frequency is measured. The predetermined frequency may be e.g. 80 Hz.

After step C, step D is carried out wherein the difference between the sensitivity at the standard frequency and the sensitivity at the predetermined cutoff frequency is calculated.

After step D, step E is carried out wherein the calculated difference is compared to the predefined reduction Δ. The predefined reduction may be chosen to be 3 dB±0.2 dB. If the calculated difference is equal to the predefined reduction, i.e. if the calculated difference is between 2.8 dB and 3.2 dB, the calibration process is terminated and the current value of the ASIC 3 setting is stored in a non-volatile memory in step F.

However, if in step E the calculated difference differs from the predefined reduction Δ by more than the allowed tolerance interval, the frequency characteristic of the ASIC 3 is adjusted in step G. For this purpose, the calculated difference is used as an input parameter for a look-up table H which stores information regarding the new setting of the frequency characteristic of the ASIC 3.

Afterwards, steps C, D and E are repeated. Accordingly, steps C, D, E and G form a successive approximation algorithm which is carried out until the frequency characteristic of the microphone 1 is set to the predetermined cutoff frequency.

The method for calibrating the microphone 1 as shown in FIG. 4 can be carried out in a last step of a manufacturing process of the microphone 1. The optimized setting for the frequency characteristics of the ASIC can be stored in a non-volatile memory, e.g. in a one-time programmable device, in step F of the method. Accordingly, this setting cannot be amended by a customer.

REFERENCE NUMERALS

1 microphone
2 transducer element
3 ASIC
$S_{mic}(f)$ sensitivity of the microphone
$f_{LLF}$ cutoff frequency of the microphone
$S_{MEMS}(f)$ sensitivity of the transducer element
$f_{LLF,MEMS}$ cutoff frequency of the transducer element
$S_{ASIC}(f)$ sensitivity of the ASIC
$f_{LLF,ASIC}$ cutoff frequency of the ASIC

I claim:

1. Method for calibrating a microphone comprising a transducer element and an ASIC, wherein the method comprises the following step:

calibrating the frequency characteristic of the ASIC such that the sensitivity of the microphone at a predetermined cutoff frequency shows a predefined reduction compared to the sensitivity of the microphone at a standard frequency.

2. Method according to claim 1, wherein the frequency characteristic of the ASIC is calibrated by a successive approximation algorithm which adjusts the frequency characteristics of the ASIC stepwise until the difference between the sensitivity of the microphone at the standard frequency and the sensitivity of the microphone at the predetermined cutoff frequency is equal to the predefined reduction.

3. Method according to claim 2, wherein, in the successive approximation algorithm, the difference between the sensitivity of the microphone at the standard frequency and the sensitivity of the microphone at the predetermined cutoff frequency is calculated, and wherein the frequency characteristics of the ASIC is adjusted based on the calculated difference and information stored in a look-up table.

4. Method according to claim 1, wherein the ASIC comprises an adjustable high pass filter and wherein the frequency characteristics of the ASIC is calibrated by adjusting the cutoff frequency of the adjustable high pass filter.

5. Method according to claim 4, wherein the cutoff frequency of the adjustable high pass filter is reduced, if the calculated difference is below the predefined reduction.

6. Method according to claim 4, wherein the cutoff frequency of the adjustable high pass filter is increased, if the calculated difference is above the predefined reduction.

7. Method according to claim 1, wherein in a last step of the method, a setting of the frequency characteristic of the ASIC is stored in a non-volatile memory.

8. Method according to claim 1, wherein the ASIC and the transducer are connected and that an output of the transducer is fed to the ASIC.

9. Method according to claim 1, wherein the frequency characteristic of the ASIC is calibrated by adapting a frequency characteristic of a transfer function implemented in the ASIC.

10. Microphone, comprising a transducer element and an ASIC, wherein the ASIC comprises an adjustable high pass filter, wherein the microphone further comprises a nonvolatile memory which stores information for a setting of the adjustable high pass filter, and wherein the stored information allow to set the adjustable high pass filter such that the sensitivity of the microphone at a predetermined cutoff frequency shows a predefined reduction compared to the sensitivity of the microphone at a standard frequency.

11. Microphone according to claim 10, wherein the transducer element defines a cutoff frequency, wherein the ASIC has a cutoff frequency, and wherein each of the cutoff frequencies of the ASIC and of the transducer element is lower than the predetermined cutoff frequency of the microphone.

12. Microphone according to claim 10, wherein the ASIC is configured to allow tuning its cutoff frequency to a value between 10 Hz and 50 Hz.

13. Microphone according to claim 10, wherein the transducer element defines a cutoff frequency in the range of 40 Hz to 80 Hz.

14. Microphone according to claim 10, wherein the ASIC comprises a preamplifier, wherein the adjustable high pass filter is integrated into the preamplifier.

15. Microphone according to claim 10, wherein the ASIC comprises a preamplifier and a second amplifier, wherein the adjustable high pass filter is arranged between the preamplifier and the second amplifier.

16. Microphone according to claim 10, wherein the ASIC comprises a preamplifier and a Sigma-Delta-converter, wherein the adjustable high pass filter is arranged between the preamplifier and the Sigma-Delta-converter.

17. Microphone according to claim 10, wherein the ASIC and the transducer are connected and that an output of the transducer is fed to the ASIC.

18. Microphone according to claim 10, wherein the frequency characteristic of the ASIC is calibrated by adapting a frequency characteristic of a transfer function implemented in the ASIC.

* * * * *